United States Patent [19]

Katogi et al.

[11] Patent Number: 4,752,771

[45] Date of Patent: Jun. 21, 1988

[54] ELECTRONIC INSTRUMENT PANEL

[75] Inventors: Kouzou Katogi; Osamu Igarashi; Keiichi Tokuyama, all of Katsuta; Hirohisa Yamamura, Hitachiota; Seiji Suda, Mito, all of Japan

[73] Assignee: Hitachi, Ltd., Tokyo, Japan

[21] Appl. No.: 768,321

[22] Filed: Aug. 22, 1985

[30] Foreign Application Priority Data

Aug. 29, 1984 [JP] Japan ..... 59-178376

[51] Int. Cl.[4] ..... G09G 3/36

[52] U.S. Cl. ..... 340/702; 340/703; 340/815.17; 340/793

[58] Field of Search ..... 340/784, 703, 702, 719, 340/793; 350/345; 540/767, 815.17

[56] References Cited

U.S. PATENT DOCUMENTS

| | | | |
|---|---|---|---|
| 3,849,979 | 11/1974 | Tanji | 340/793 X |
| 3,893,081 | 7/1975 | Hopkins | 340/815.17 X |
| 3,924,227 | 12/1975 | Stolov | 340/702 |
| 4,114,366 | 9/1978 | Renner et al. | 340/767 X |
| 4,185,266 | 1/1980 | Nakashima | 340/815.17 X |
| 4,254,408 | 3/1981 | Kerschner, III | 340/815.17 X |
| 4,294,524 | 10/1981 | Stolov | 340/784 |
| 4,319,237 | 3/1982 | Matsuo et al. | 340/784 X |
| 4,438,453 | 3/1984 | Alston | 340/702 |
| 4,470,666 | 9/1984 | Eick | 350/345 X |
| 4,487,481 | 12/1984 | Suzawa | 340/784 X |
| 4,578,672 | 3/1986 | Oota et al. | 340/702 |

FOREIGN PATENT DOCUMENTS

| | | | |
|---|---|---|---|
| 0148496 | 11/1979 | Japan | 340/703 |
| 2142180 | 1/1985 | United Kingdom | 340/703 |

*Primary Examiner*—Marshall M. Curtis

*Attorney, Agent, or Firm*—Antonelli, Terry & Wands

[57] ABSTRACT

In a color liquid crystal type electronic instrument panel, the quantity of light to be radiated from a background light source is changed in accordance with a color to be displayed. The color liquid crystal type electronic instrument panel is of the type that a plurality of plural-primary-color stripe filters are disposed on each segment of a display element in the longitudinal direction of the segment; a voltage is applied to electrodes corresponding to the stripe filters having a color selected based on the contents to be displayed, and the background light source is positioned at the back of the display element to enable color-displaying. A device for detecting the brightness of outdoor light is further provided in the liquid crystal display type electronic instrument panel, wherein the quantity of light to be radiated from the background light source is changed in accordance with a detected signal by the detecting device.

5 Claims, 12 Drawing Sheets

INPUT WAVEFORM

OUTPUT WAVEFORM

TON ≅ CR

ELECTRONIC INSTRUMENT PANEL

BACKGROUND OF THE INVENTION

The present invention relates to a dashboard or instrument panel for vehicles such as automobiles, and more particularly to an illumination method for an electronic instrument panel using a color liquid crystal display.

As the development in electronics toward various instruments advances, electronic instrument panels using liquid crystal display elements have recently widely been used for automobiles and the like.

In the early stage of the development, such liquid crystal display elements could only operate to turn on and off. However, recently elements capable of changing display color, i.e., so-called color liquid crystal display elements have widely been used in practice.

Among such color liquid crystal display elements, various types are known. For example, in the Official Gazette of Japanese Patent Unexamined Pubication No. 56-21182 a guest-host type liquid crystal capable of effecting a multiple color display is disclosed, and in the Official Gazette of Japanese Patent Unexamined Publication No. 58-150935 a smectic type liquid crystal capable of effecting a multiple color display is disclosed.

Liquid crystal display elements are passive elements with respect to light so that a so-called background light source is required at the back of the liquid crystal display elements, for example, of the transmission type, which are commonly used for electronic instrument panels. By changing the color of the background light, a multiple color display is obtained which is disclosed in the Official Gazette of Japanese Patent Unexamined Publication no. 58-88778. Other various methods for a multiple color display have been proposed heretofore, for example, a multiple color display method with moving filters has been proposed. Guest-host and smectic type liquid crystals are however expensive as compared with common TN type liquid crystals. Thus, it is difficult to manufacture a low cost instrument panel.

The method employing the color change of the background light also encounters difficulties in obtaining a partial color change on the display section.

In view of the above, there is disclosed in the Official Gazette of Japanese Patent Unexamined Publication No. 58-147781 a color liquid crystal wherein primary color stripe filters are provided for each portion of the display section, e.g., each segment of the seven-segment display device. With this method, a multiple color display can be realized by using inexpensive TN type liquid crystals. Moreover, it is advantageous in that various kinds of colors can be produced by mixing primary colors.

The use of such color liquid crystals with stripe filters however is associated with a drawback that the ability of visual recognition is degraded due to the change of a display area for each color and hence due to the change of luminance for each color at the display section.

The more detailed description for the above will be given with reference to the accompanying drawings. In FIG. 2, the display segments of a primary color stripe type color liquid crystal are shown. Each of the seven segments is divided minutely into 3N stripes. Three groups of N stripes constitute the display section. R (red), G (green) and B (blue) stripe filters are respectively provided for each stripe of the same group. Three colors R, G and B and a desired number of other colors to be produced by mixing R, G and B are possible. For example, seven colors in all (red, green, blue, cyan, magenta, yellow and white) can be produced.

In this case, the display areas occupied by respective colors are different from each other as shown in FIG. 3. Particularly, assuming that the display area for a white color is 1, to be obtained by rendering all of the corresponding R, G and B stripe filters active, then each display area for cyan, magenta and yellow colors is $\frac{2}{3}$ and each display area for R, G and B is $\frac{1}{3}$. Therefore, the display luminance varies with color.

SUMMARY OF THE INVENTION

It is an object of the present invention to eliminate the above prior art drawbacks and to provide a color liquid crystal display type electronic instrument panel capable of always maintaining a superior ability of visual recognition and preventing the change of display luminance even at the change of display color.

In order to achieve the above object, the present invention features in that as a background light source necessary for the liquid crystal display elements, a light source whose brightness can be controlled is used to thereby adjust the brightness of the background light source in accordance with the color to be displayed.

According to another embodiment of the present invention, an electronic instrument panel capable of always displaying with a most suitable contrast and having a superior ability of visual recognition can be realized by automatically changing the display luminance in accordance with the brightness outside the vehicle.

DESCRIPTION OF THE PREFERRED EMBODIMENTS

The electronic instrument panel of the present invention will now be described in detail in connection with the embodiments shown in the accompanying drawings.

Figure 1:
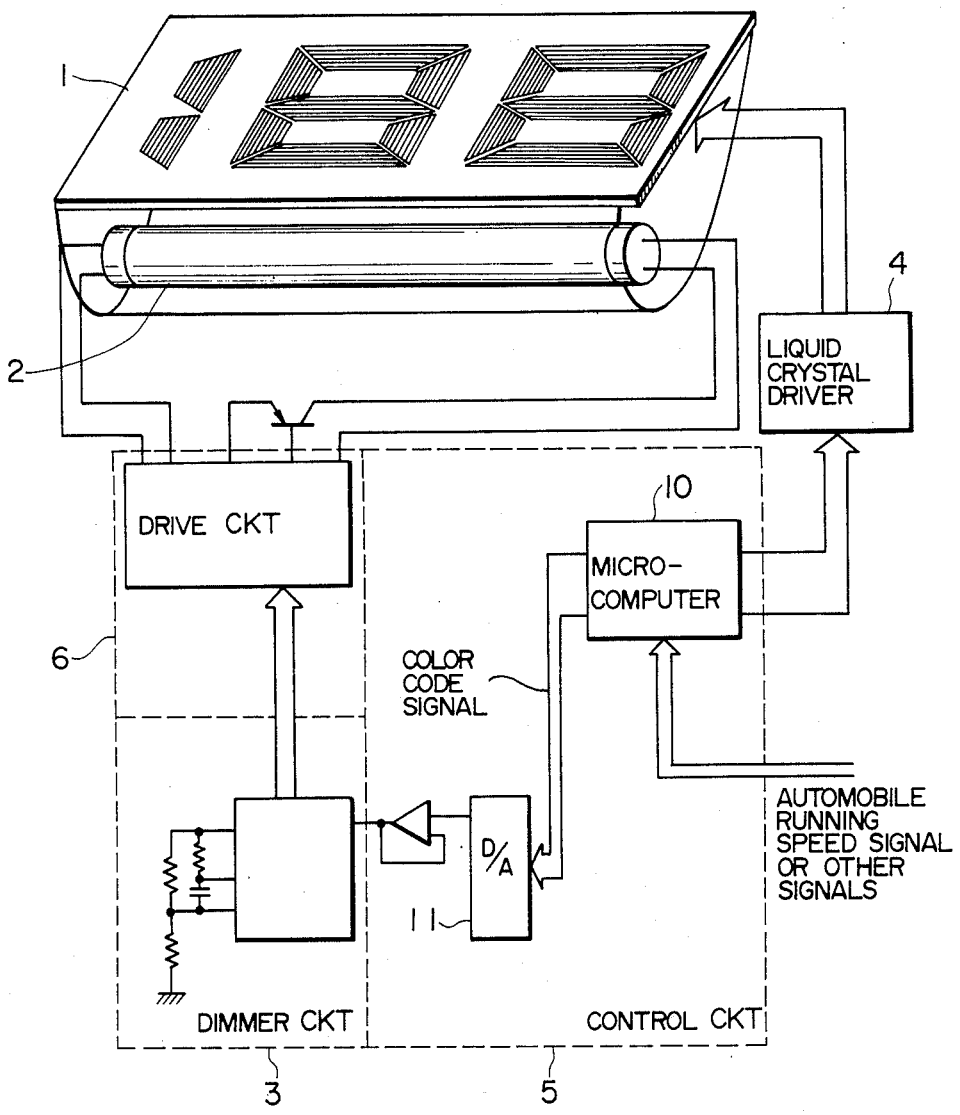
FIG. 1 shows a schematic circuit diagram of the electronic instrument panel according to an embodiment of the present invention.
Figure 2:
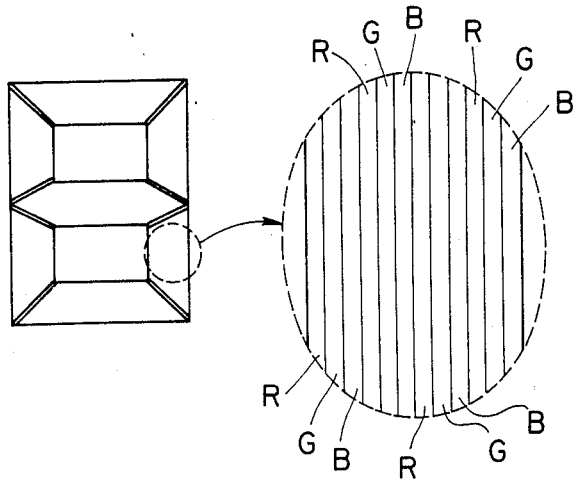
FIG. 2 PRIOR ART
FIG. 2 is a view for explaining one example of a stripe filter type color liquid crystal.
Figure 4:
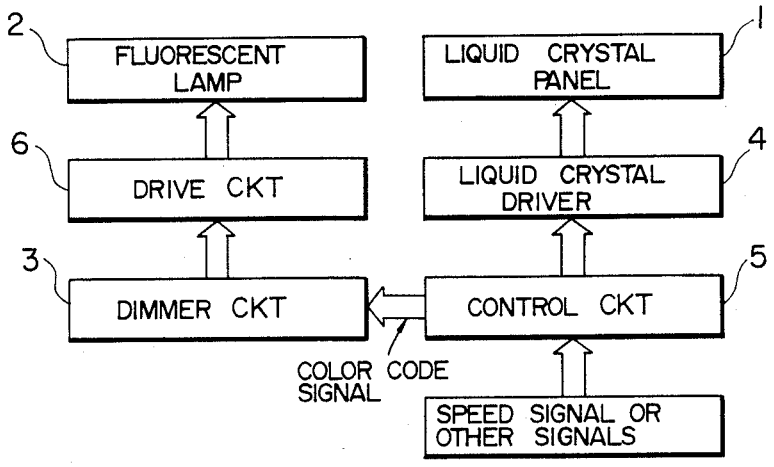
FIG. 4 is a block diagram showing one example of the fundamental arrangement of the present invention.

Referring now to FIG. 1 showing an embodiment of the present invention, numeral 1 represents a transmission type color liquid crystal display panel constituting a display element of an electronic instrument panel for vehicles. Numeral 2 represents a fluorescent lamp 2 constituting a background light source for the color liquid crystal display panel 1. Numeral 3 represents a dimmer circuit for controlling the brightness of the fluorescent lamp 2. Numeral 4 represents a liquid crystal driver for driving the color liquid crystal display panel 1 to conduct a color display. Numeral 5 represents a control circuit composed of such as a microcomputer 10 and a digital to analog converter D/A 11, and numeral 6 represents a drive circuit for illuminating the fluorescent lamp 2. The above circuit arrangement is briefly shown as a block diagram of FIG. 4.

The microcomputer 10 of the control circuit 5 receives a speed signal for example from a speed sensor of an automobile and enables the speed display on the color liquid crystal display panel 1. In this case, the microcomputer 10 operates, by positively employing the color display function of the color liquid display panel 1, to change the display color in response to the speed of the automobile. Therefore, the driver can fully recognize the colored display speed; e.g., a green color for a low speed, yellow color for a middle speed and red color for a high speed.

Simultaneously therewith, the microcomputer 10 supplies a color code signal for controlling the display color at the color liquid crystal display panel 1, to the dimmer circuit 3 via the D/A 11, thereby controlling the brightness of the fluorescent lamp 2 in accordance with the display color.

The brightness control for each display color will further be described in detail. First of all, the display area in the color liquid crystal display panel 1 varies with the display color as explained with reference to FIG. 3. As a result, the display luminance also varies in proportion to the display area.

Figure 5A:
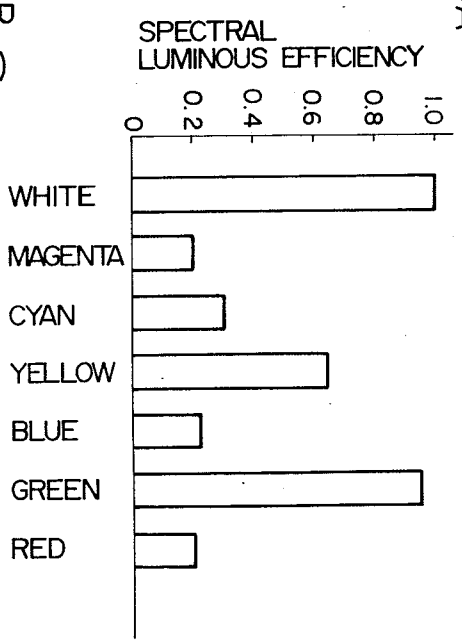
FIGS. 5A, 5B and 5C are graphs for explaining the operation and effects of the present invention.

Second, in addition to the above luminance variation, the spectral luminous efficiency of human eyes varies with color as well known in the art. That is, as shown in FIG. 5A, even with colors of the same brightness, apparent brightness for human eyes varies. For example, magenta is recognized as dark as 0.2 as compared with white, assuming that the brightness of white is 1.

Figure 3:
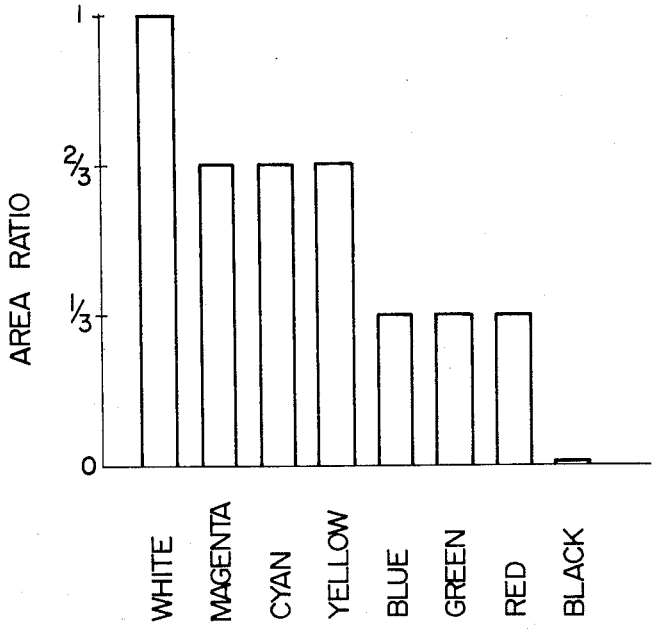
FIG. 3 PRIOR ART
FIG. 3 is a graph for explaining a relation between display colors and their display areas.

Taking into consideration of the characteristics shown in FIGS. 3 and 5A, the display luminance can be obtained which is required for keeping the same brightness as sensed with human eyes even if display color changes. It is understood as shown in FIG. 5B that with the luminance of white assumed as 1, the luminance required for magenta is about 7.4 while the luminance for blue and red is as large as 12.

On this account, the microcomputer 10 is provided with a color code table stored in advance in such as ROMs. The microcomputer 10 searches the color code table in accordance with the display color on the color liquid crystal display panel 1 and supplies a color code signal having the characteristic shown in FIG. 5B to the dimmer circuit 3 via the D/A 11 so as to control the brightness of the fluorescent lamp 2.

Figure 5B:
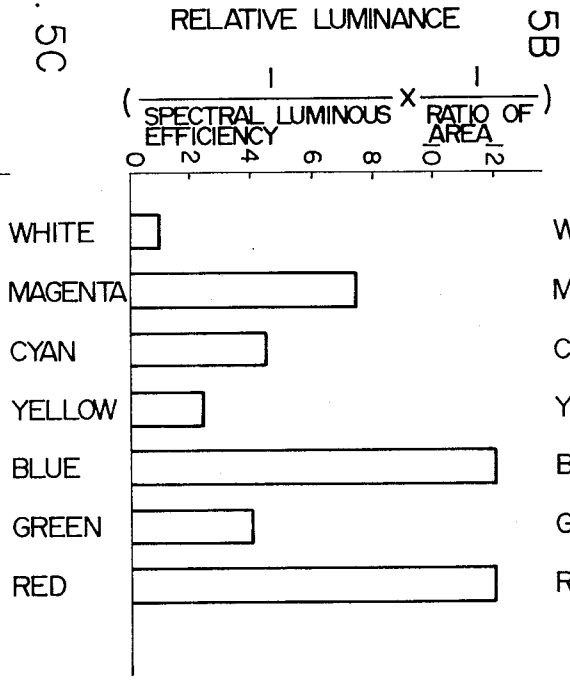
Figure 5C:
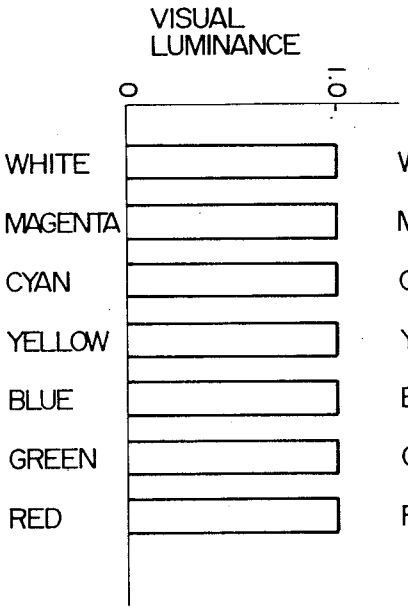

Consequently, according to this embodiment, the brightness of the fluorescent lamp 2 is controlled to have the brightness shown in FIG. 5B in accordance with the display color on the color liquid crystal display panel 1. For example, assume that the luminance for white is 1, the luminance for magenta is controlled to about 7.4 and that for blue and red is to 12. Therefore, as shown in FIG. 5C, irrespective of a change of display color, the luminance is always recognized as constant for human eyes, thus enabling to retain a sufficient and superior ability of visual recognition.

Next, an example of the dimmer circuit 3 shown in FIG. 6 will be explained.

Figure 6:
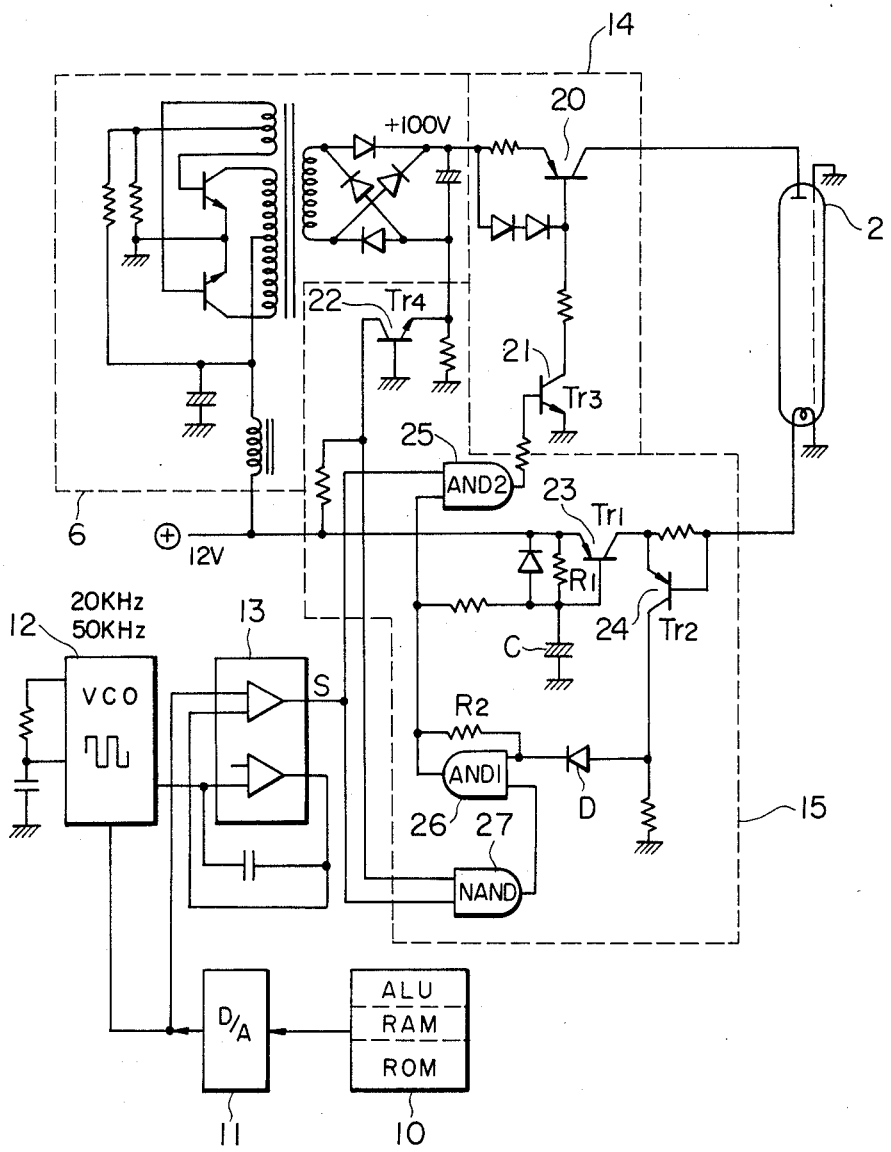
FIG. 6 is a circuit diagram showing an embodiment of a dimmer circuit according to the present invention.

In the embodiment of FIG. 6, the power supply to the fluorescent lamp 2 is subject to switching at a high speed in accordance with the color code signal fed from the microcomputer 10 of the control circuit 5 via the D/A 11. The frequency and duty ratio of the switching operation is changed to control the brightness of the fluorescent lamp 2, and also the power for heating the filaments of the fluorescent lamp 2 is controlled at the start of illumination and during the operation under a low quantity of light. In the figure, numeral 12 represents a VCO (Voltage Controlled Oscillator), numeral 13 stands for a duty ratio controller, 14 for a switching circuit, 15 for a filament heating controller, 20 to 24 for transistors, 25, 26 for AND gates, and numeral 27 stands for a NAND gate.

The fluorescent lamp 2 is energized with a DC voltage supplied, via a switching transistor 20, from the drive circuit 6 comprising a DC-DC converter. The brightness of the lamp is controlled in accordance with the duty ratio of the transistor 20 turning on and off.

The color code signal (analog signal) supplied from the microcomputer 10 via the D/A 11 is inputted to the VCO 12 and to the duty controller 13. As a result, a switching signal S outputted from the duty controller 13 is a rectangular wave signal, varies its frequency for example over the rang of 20 to 50 KHz in accordance with the color code signal, and varies its duty ratio for example over the range of 10% to 90%. The switching signal S is supplied through the AND gate 25 to the transistor 20 so that the transistor 20 is rendered to turn on and off in response to the switching signal S. Thus, in proportion to the duty (which is controlled by the color code signal) of the switching signal S, the brightness of the fluorescent lamp 2 is controlled.

Figure 7:
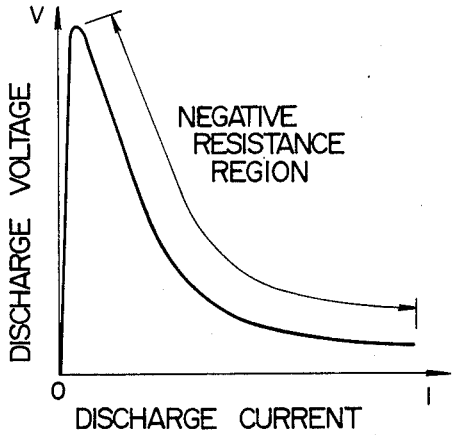
FIGS. 7 and 8 are graphs for explaining the characteristic of a fluorescent lamp.

As well known, since the voltage-current characteristic of the fluorescent lamp 2 shows a negative resistance as shown in FIG. 7, the collector current while the transistor 20 is conductive is adapted to have a predetermined saturation characteristic, thereby stabilizing the operation of the fluorescent lamp 2.

Figure 8:
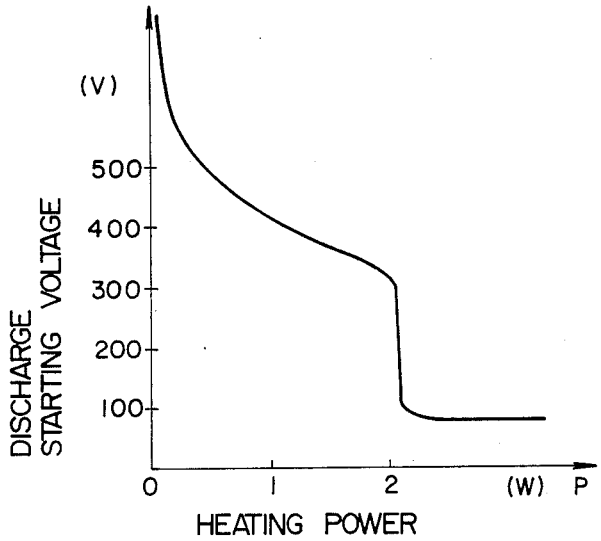

As also well known, it is necessary to preheat the filament at the start of illumination of the fluorescent lamp 2. Furthermore, it is a characteristic nature of the fluorescent lamp 2 that a difficulty in illuminating occurs during the time the discharge current becomes small because of the lowering of a filament temperature and hence a high discharge voltage. An example of a relation of the heating power relative to the discharge voltage is as shown in FIG. 8.

The filament heating control circuit 15 is provided, in view of the above characteristic features of a fluorescent lamp, for always attaining a stable illumination control. After the power is supplied, e.g., after the ignition switch of the automobile is turned on, the transistor 23 continues to turn on during a predetermined time determined by the time constant defined by a resistor R1 and a capacitor C. During that time, the filament of the fluorescent lamp 2 is supplied with current. As the filament current flows, the transistor 24 turns on to make the AND gate 26 enable by way of a diode D, thereby rendering the output at the AND gate 26 high with the help of the output from the NAND gate 27. Thereafter a latch function by a resistor R2 is effected so that the output of the AND gate 26 is maintained high until the output of the NAND gate 27 becomes low. With such circuit arrangement, at the start of illumination, the transistor 20 is controlled so as not to turn on by closing the AND gate 25 until the filament current is supplied. After the filament current is supplied, one input of the AND gate 25 connected to the output of the AND gate 26 is maintained high. Therefore, the switching signal S is allowed to input to the transistor 21.

In case the fluorescent lamp 2 is being illuminated, the transistor 22 turns on to hold the upper input, as seen in the drawing, of the NAND gate 27 low. Therefore, in this case, irrespective of the switching signal S, the output of the NAND gate 27 maintains high.

If the brightness of the fluorescent lamp 2 is controlled dark in response to the color code from the microcomputer 10, the discharge current becomes substantially small and the filament temperature becomes low to thereby result in a rise of the discharge voltage (refer to FIG. 8) and an unstable state of illumination. In this case, the reduction in current of the fluorescent lamp 2 causes the transistor 22 to turn off so that the switching signal S develops at the output of the NAND gate 27 to turn on the transistor 23. Consequently, a current supply to the filament of the fluorescent lamp 2 starts.

As seen from the embodiment shown in FIG. 6, if a discharge current passing through the fluorescent lamp 2 is or becomes smaller than a preset value at the start of illumination or during its operation, a heating current is automatically supplied to the filament, thereby always enabling a stable control of quantity of light of the fluorescent lamp 2 and a reliable display on the color liquid crystal display panel 1.

An example of the color code table provided in the microcomputer 10 is shown in Table 1.

TABLE 1

| Color | Duty (%) |
|---|---|
| White | 5 |
| Magenta | 38 |
| Cyan | 23 |
| Yellow | 13 |
| Blue | 60 |
| Green | 20 |
| Red | 60 |

In Table 1, the duty ratio is related to an on-off duty of the transistor 20, which uses the same ratio as in FIG. 5B.

The display color control for the color liquid crystal display panel 1 will then be described.

As previously discussed, the provision of a color display electronic instrument panel capable of changing the display color based upon the display contents or data enables arousal of the driver's attention without For instance, in case the running speed or the number of rotations of the vehicle engine is displayed, the display color is changed based upon the speed or the rotation number: e.g., the change of color to red means that the speed or the rotation number has changed to excess a certain upper limit. In this case, not only the color change, but also a higher brightness than usual is also applicable.

Figure 9:
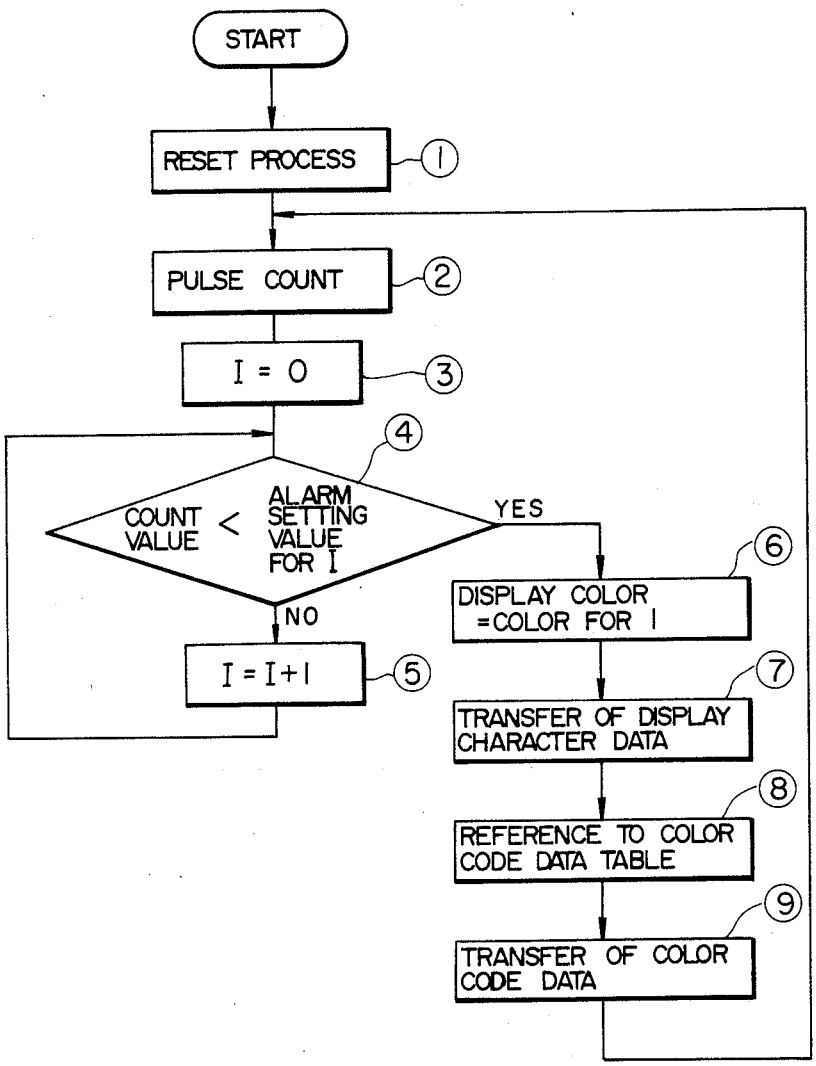
FIG. 9 is a flow chart showing an example of display color control operations according to the present invention.

FIG. 9 is a flow chart showing one example of the operation of the microcomputer 10 required for changing the display color based upon the running speed of the vehicle. First, after the reset process at step (1), pulses from a speed sensor are counted for a predetermined time at step (2). After the process at step (3), the set value for I is compared with the count value at that time at step (4). If the count value is larger than the set value, the contents of I is incremented. On the contrary, if the set value exceeds the count value, then at step (6) the display color corresponding to the value I at that time is selected. Thereafter, the selected color is displayed at steps (7) to (9) and the next counting operation starts.

It is here assumed that the set value I=0 is representative of a speed of 50 km/h, the value I=1 is 80 km/h, the value I=2 is 100 km/h and the value I=3 is 120 km/h and that the display color for I=0 is white, the color for I=1 is green, the color for I=2 is yellow and the color for I=3 is red.

Then, at a speed lower than 50 km/h, the processes at steps (6) to (9) advance with I=0 so that the display color is white.

At a speed exceeding 50 km/h and still not reaching 80 km/h, the processes at steps (6) to (9) advance with I=1 so that the display color at this speed is green. Similarly, at a speed from 80 km/h to 100 km/h the color is yellow, and at a speed from 100 km/h to 120 km/h is red. The display color is changed based upon the speed thereby enabling direction of the driver's attention thereto.

In the above description, although the display color has been changed based upon the running speed of a vehicle, the present invention is not limited thereto. It is apparent that the change of color is effected also based upon any desired display contents, such as the number of engine rotations, the temperature of engine cooling water, and the amount of residual fuel. Furthermore, the change of display luminance as well as the change of display color is also applicable, as described in the foregoing.

In the above embodiments, although the present invention has been applied to transmission type color liquid crystals, it is apparent that the present invention is also applicable to semi-transmission type color liquid crystals and can enjoy similar advantageous effects.

As seen from the above description of the present invention, even with electronic instrument panels constructed of stripe filter type color liquid crystals, it is possible to control as desired the change of luminance to be caused by a change of display color. Therefore, it is possible to provide an electronic instrument panel which can eliminate the prior art drawbacks, has a superior ability of visual recognition and is inexpensive.

Another embodiment of the present invention will be described hereinafter. In this embodiment, the luminance of the display section is automatically changed further in accordancd with the brightness of the outdoors, thereby aiming at a superior visual recognition. In particular, the outdoor brightness varies to a large extent with day and night or with weather conditions so that the ratio of lightness to darkness has a large value. Therefore, if the brightness of the display section is fixed, the driver has a great difficulty in viewing the display section.

The embodiment will be described in connection with FIGS. 10 to 16. In order to understand the embodiment with ease, the description thereof is directed to a means for automatically changing the brightness of the display section in accordance with the brightness outside of the vehicle.

Figure 10:
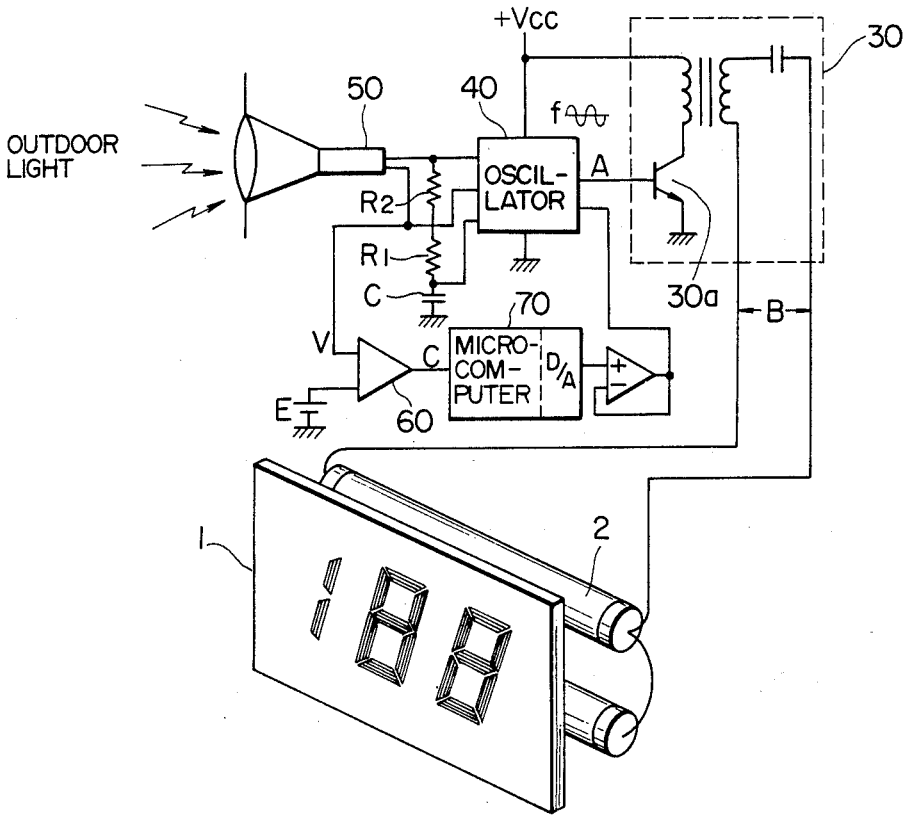
FIG. 10 shows an arrangement of another embodiment of the electronic instrument panel according to the present invention.

In FIG. 10, numeral 1 represents a transmission type liquid crystal display panel, numeral 2 represents a fluorescent lamp, and numeral 70 represents a control circuit composed of a microcomputer. Numeral 30 represents a DC-AC converter, numeral 40 represents an oscillator, numeral 50 represents a photoelectric conversion element, and numeral 60 represents a comparator.

The display panel 1 constituting the display section of the electronic instrument panel is driven by a not shown drive circuit (for example, by the circuit designated by reference number 4 in FIG. 1).

The fluorescent lamp 2 illuminates the display panel 1 from the back of the panel 1, thus realizing the transmission type display function of the display panel 1.

The DC-AC converter 30 functions to supply a certain AC voltage to the fluorescent lamp 2 after converting a DC voltage Vcc.

The oscillator 40 generates a rectangular wave signal having a constant high level duration and may be an IC known as HA-17555 by its type name. The oscillator 40 functions to make a switching transistor 30*a* of the DC-AC converter 30 turn on and off by supplying the reactangular wave signal. The frequency of the rectangular wave signal is given by the following equation:

$$f \simeq \frac{1}{C(R1 + R2)} \quad (1)$$

The photoelectric conversion element 50 made of photoconductive elements such as CdS cells is mounted on the vehicle such that outdoor light rays are received by the light reception surface of the element 50. The photoelectric conversion element 50 is connected in parallel with a resistor R2 determining the oscillation frequency f of the oscillator 40 (refer to the equation (1)). Therefore, as the brightness of the outdoors is enhanced, the resistance value of the resistor R2 is lowered to thereby make the oscillation frequency f high.

The comparator 60 functions to compare the output voltage V from the photoelectric conversion element 50 with a constant reference voltage E and generate a signal C which takes a high level while $V<E$ and a low level while $V>E$. The operation of the microcomputer 70 will be described later.

Next, the operation of the embodiment will be described.

Figure 11A:
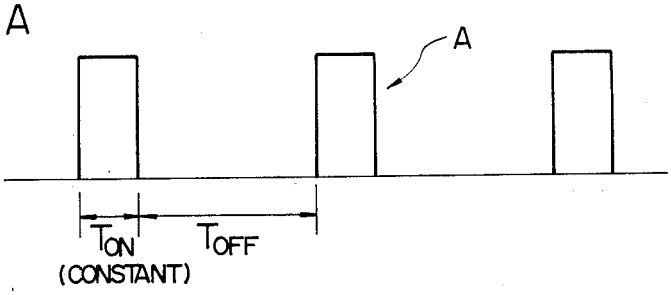
FIGS. 11A and 11B show waveforms for explaining the operation of the embodiment.
Figure 11B:
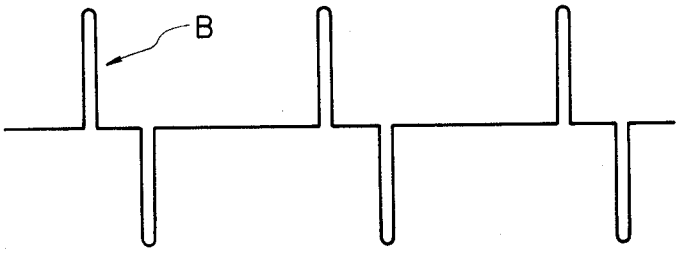

The oscillation output A of the oscillator 40 is of a rectangular wave having a constant on-duty or high level duration, as shown in FIG. 11A. Consequently, the output voltage B of the DC-AC converter 30 becomes of a pulse wave with positive and negative peaks as shown in FIG. 11B. In the embodiment, the oscillation frequency f of the oscillator 40 is set in the range of 20 KHz to 100 KHz for example.

The fluorescent lamp 2 is supplied with the output voltage B from the DC-AC converter 30 so that the lamp 2 is driven into illumination at each pulse of the output voltage B, i.e., at each edge portion of the rectangular wave output A of the oscillator 40.

Since the width of each pulse of the output voltage B is determined by the circuit constants and has a constant value, the light emission amount at each pulse of the output voltage B becomes also constant. Therefore, the light emission amount (average value) of the fluorescent lamp 2 per unit time becomes proportional to the number of light emissions, i.e., the frequency f of the oscillator 40.

As described above, the oscillation frequency f of the oscillator 40 varies with the quantity of incident light upon the photoelectric conversion element 50, i.e., with the outdoor brightness. Consequently, the frequency f becomes high as the outdoors becomes lighter, while on the other hand the frequency f becomes low as the outdoors becomes darker.

Figure 12:
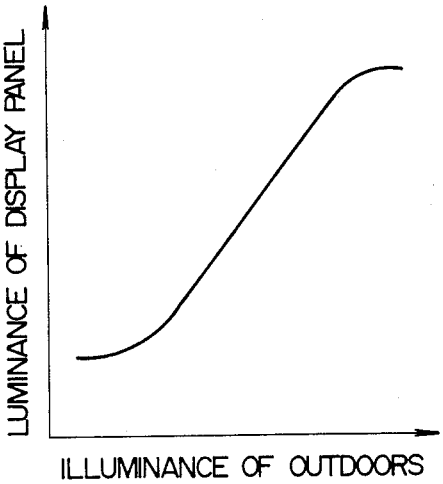
FIG. 12 shows a characteristic curve for explaining the operation of the embodiment.

According to the embodiment and as shown in FIG. 12, the luminance of the display panel 1 automatically changes in accordance with the outdoor brightness: the lighter the outdoors becomes, the higher the luminance of the the display panel 1 becomes; while the darker the outdoors becomes, the lower the luminance of the display panel 1 becomes. Thus, a display with its contrast most suitably controlled can always be realized.

As is apparent from FIGS. 11A and 11B, the output voltage B of the DC-AC converter 30 is developed only at the edge portion of the oscillation output A of the oscillator 40. The remaining high level portion of the oscillation output A, however,long the duration may be, only serves as the collector loss of the transistor 30*a* of the DC-AC converter 30 without contributing to the generation of the output voltage B.

Therefore, the width of the rectangular wave pulse of the oscillation output A of the oscillator 40 is sufficient only if it has a minimum time duration required for the transistor 30*a* to become saturated after the transistor turns on from its off-state. The longer time duration than the minimum time duration contributes only to an increase of the collector loss. This is the reason why the oscillator 40 with a constant on-duty of the oscillation output A has been employed.

Figure 13:
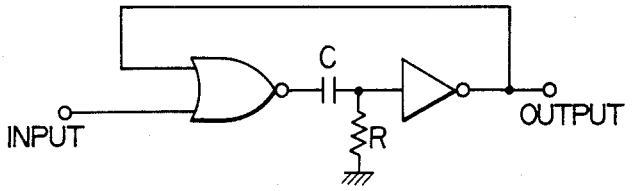
FIG. 13 is a circuit diagram showing one example of a shaping circuit.
Figure 14A:
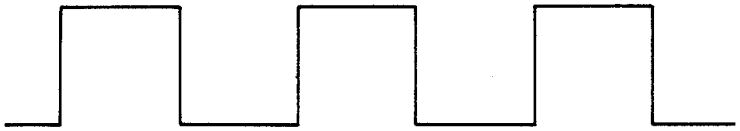
FIGS. 14A and 14B show waveforms for explaining the operation of the shaping circuit.
Figure 14B:
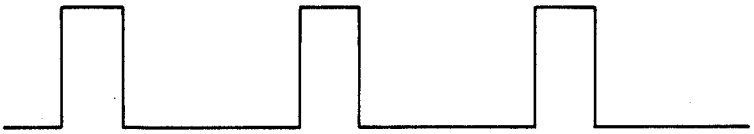

An oscillator with its duty ratio of 1:1 may be used. In this case, a wave shaping circuit made of a monostable multivibrator such as shown in FIG. 13 is coupled between the oscillator output and the DC-AC converter 30 input so that the input waveform of FIG. 14A is shaped to the output waveform of FIG. 14B.

During the automatic luminance control of the display panel 1 based upon the outdoor brightness, there may arise an occasion that it becomes difficult to view the display panel when an abrupt change of the outdoor brightness occurs.

In such an occasion, a low pass filter may be used coupling to the output of the photoelectric conversion element 50, thereby eliminating the abrupt brightness change in the display panel and facilitating an easy visual recognition.

Next, the operation of the microcomputer 70 will be described.

Figure 15A:
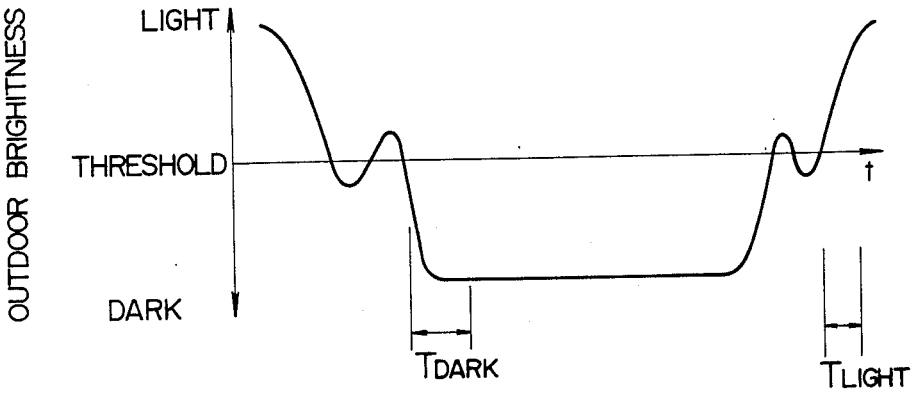
FIGS. 15A and 15B show the characteristic curves for explaining the operation of the embodiment of FIG. 10.
Figure 15B:
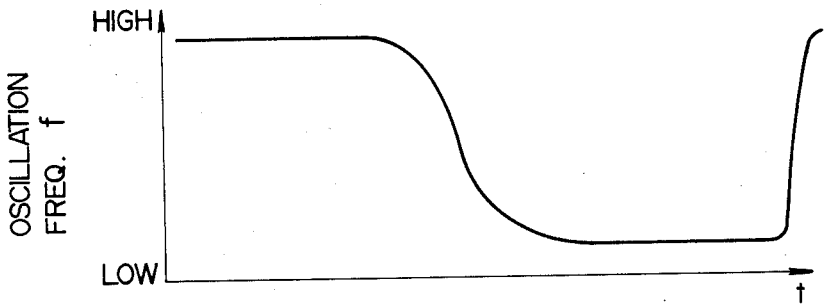

Considering the vehicle passing in a tunnel and being under the automatic luminance control of the display panel 1 based upon the outdoor brightness, a thereshold value is set for the outdoor brightness, as shown in FIG. 15A. The luminance of the display panel 1 is changed either high or low based on whether the outdoor brightness exceeds the threshold value or not. In addition to the above, considered is the fact that there is a difference between adaptation times of human eyes; i.e., between a dark adaptation of human eyes experienced on a change from a light background to a dark background and a light adaptation of human eyes experienced on a change from a dark one to a light one. In such conditions, one method is to change the oscillation frequency f of the oscillator 40 as shown in FIG. 15B relative to the change of an outdoor brightness as shown in FIG. 15A

To avoid a response to a minute change of the outdoor brightness and to ensure a more practical control at all times, it is desirable to start the luminance control of the display panel 1 only when the outdoor brightness in excess of the threshold value continues fo a predetermined time T.

To this end, the microcomputer 70, which receives an output C from the comparator 60, starts the measurement of time, during which either one of high and low level outputs C continues to hold, every time a level change of the output C occurs. If the measured time becomes longer than the predetermined time T, then the microcomputer 70 is allowed to start the luminance control. In this case also, the luminance is gradually changed in compliance with the above described adaptation of human eyes: in case the outdoor brightness changes from a high luminance to a low luminance, the luminance of the display panel is changed relatively at a low rate so as to match the dark adaptation, while on the other hand in case the outdoor brightness changes from a low luminance to a high luminance, the luminance of the display panel is changed relatively at a high rate so as to match the light adapation. Therefore, the microcomputer 70 operates to change the change rate of the output voltage from the D-A converter in accordacne with the level change direction of the output C from the comparator 60, thereby controlling the oscillation frequency f of the oscillator 40 in the manner as shown in FIG. 15B.

Figure 16:
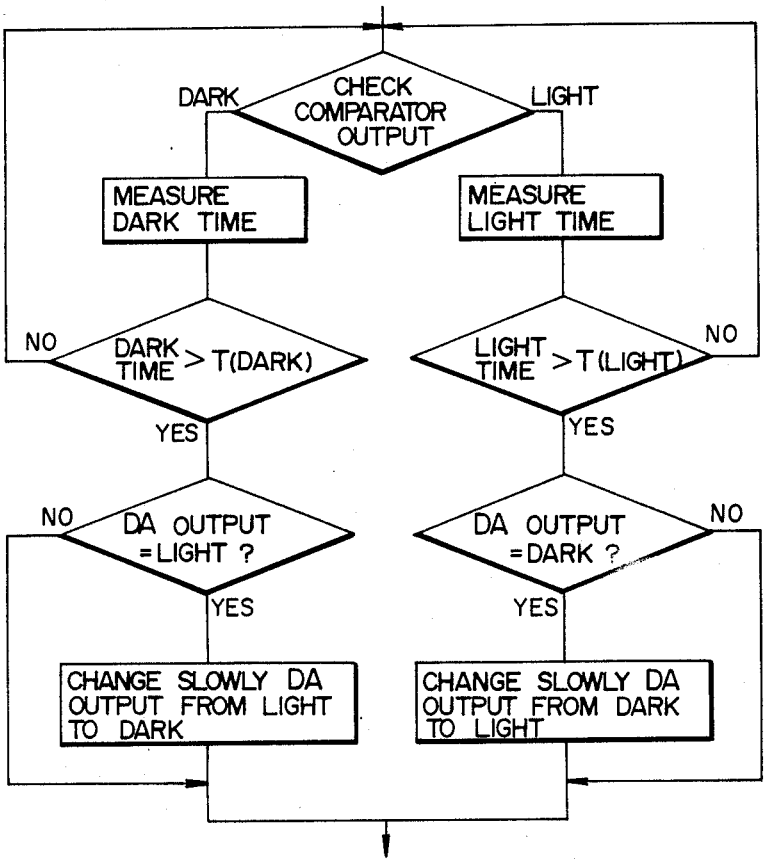
FIG. 16 is a flow chart for explaining the operation of the embodiment.

The operation of the microcomputer 70 performing such function can be shown by a flow chart of FIG. 16.

In the above embodiments, the fluorescent lamp 2 has been used as a light source for the display panel 1, however a candescent lamp is also applicable instead. In this case, a DC-AC converter is not needed, but instead of the converter a current control circuit only can suffice.

Furthermore, it is apparent that various transmission type and semi-transmission type character and display panels are also applicable to the display panel 1 without limiting only to a transmission type liquid crystal display panel.

As described above with reference to the embodiment, the luminance of the display section of the electronic instrument panel is automatically changed in accordance with the brightness outside the vehicle. Thus, it is possible to provide an electronic instrument panel which can eliminate the prior art drawbacks, obtain a display with its contrast most suitably controlled, and is efficient in its ability of visual recognition.

We claim:

1. An electronic instrument panel comprising:

a color liquid crystal display panel including primary color stripe filters forming at least a part of a display element of said element of said electronic instrument panel;

a fluorescent lamp forming a backlight source for said color liquid crystal display panel;

driving circuit means for driving said fluorescent lamp;

dimmer circuit means for controlling a brightness of said fluorescent lamp such that a predetermined brightness is associated with each color to be displayed on said display element; and control means for controlling information to be displayed on said color liquid crystal display panel including the color of the diplay of said color liquid crystal display panel in accordance with external information and for transmitting a color code signal corresponding to said color to be displayed to said dimmer circuit means, said dimmer circuit means being responsive to said color code signal for controlling the brightness of said fluorescent lamp in accordance therewith.

2. An electronic instrument panel according to claim 1, wherein said display element comprises a seven-segment display element.

3. An electronic instrument panel according to claim 1, wherein said fluorescent lamp comprises a white color fluorescent lamp.

4. An electronic instrument panel of a liquid crystal display type including primary color strip filters for enabling color-display of each segment of a seven-segment display element comprising:

outdoor light detection means for detecting the brightness of outdoor light and for generating a control signal in accordance therewith; and AC voltage generating means for generating an AC voltage for enabling illumination of a fluorescent lamp utilized as backlight source for said display element, sad AC voltage generating means enabling control of a root means square value of said AC voltage;

said AC voltage generating means includes means for controlling a quantity of light of said fluorescent lamp in accordance with a color to be displayed on said display element, and said AC voltage generating means controls said root means square value of said AC voltage in accordance with said control signal of said outdoor light detection means so as to control the illumination of said fluorescent lamp in accordance therewith.

5. An electronic instrument panel according to claim 4, wherein said AC voltage generating means includes means for delaying the control of said root mean square value of said AC voltage in accordance with said control signal, said delay means controlling a delay time thereof in accordance with a direction change of said control signal.

* * * * *